United States Patent [19]

Gavin et al.

[11] Patent Number: 4,645,108

[45] Date of Patent: Feb. 24, 1987

[54] DISPENSING CARTON AND BLANK THEREFOR

[75] Inventors: James R. Gavin, Pittsford, N.Y.; Nicholas Phillips, Carol Stream, Ill.

[73] Assignee: Mobil Oil Corporation, New York, N.Y.

[21] Appl. No.: 777,994

[22] Filed: Sep. 20, 1985

[51] Int. Cl.[4] ..... B65D 85/671

[52] U.S. Cl. ..... 225/103; 206/390; 206/395; 229/17 S

[58] Field of Search ..... 225/48–50, 225/106; 206/390, 395, 396, 409; 221/46, 63, 32, 26; 229/17 S, 17 R

[56] References Cited

U.S. PATENT DOCUMENTS

| | | | |
|---|---|---|---|
| 2,115,673 | 4/1938 | Stompe | 229/17 S X |
| 3,144,970 | 8/1964 | Beschmann | 225/48 X |
| 3,161,336 | 12/1964 | Loescher | 225/106 |
| 3,178,086 | 4/1965 | Palmer | 225/48 X |
| 4,006,854 | 2/1977 | Gibson et al. | 206/409 X |
| 4,289,262 | 9/1981 | Finkelstein | 225/106 |
| 4,583,642 | 4/1986 | Blythe et al. . | |

*Primary Examiner*—Frank T. Yost

*Attorney, Agent, or Firm*—Alexandria J. McKillop; Michael G. Gilman; Charles J. Speciale

[57] ABSTRACT

A dispensing carton for plastic bags is disclosed in which the bags may be removed from aperture openings located on three different sides of the carton. A blank for the dispensing carton is also disclosed.

6 Claims, 5 Drawing Figures

DISPENSING CARTON AND BLANK THEREFOR

RELATED APPLICATIONS

This application is related to the following commonly assigned applications and patents:

Application Ser. No. 589,808, filed Mar. 15, 1984;

Application Ser. No. 842,078, filed Mar. 20, 1986, which is a continuation of Ser. No. 599,378, filed Apr. 12, 1984, now abandoned;

Application Ser. No. 614,008, filed May 25, 1984, now U.S. Pat. No. 4,583,642;

Application Ser. No. 687,792, filed Dec. 31, 1984, now U.S. Pat. No. 4,597,494;

Application Ser. No. 777,995, filed Sept. 20, 1985.

BACKGROUND OF THE INVENTION

1. Field of the Invention

The invention relates to a rigid container or carton for dispensing a roll of small plastic bags connected to one another. The invention further relates to a blank for such dispensing carton.

2. Description of the Prior Art

The prior art discloses a wide variety of cartons for dispensing flexible materials. U.S. Pat. No. 3,826,361 discloses dispenser systems adapted to handle flat plastic garbage or trash bags in which the bags are arranged in overlapping sequence. U.S. Pat. No. 4,346,829 discloses a roll dispenser carton for food wrap sheet materials in which the cutting edge structure permits the free end of the sheet material to be retained on the cutting edge after the withdrawn sheet material has been torn therefrom. U.S. Pat. No. 4,306,687 discloses a cardboard container and blank in which a roll of sheet material is withdrawn through a slotted top. Other containers for dispensing a roll of flexible material are disclosed in U.S. Pat. Nos. 3,237,826, 3,718,251, 4,460,088, and 4,006,854.

SUMMARY OF THE INVENTION

The present invention relates to a dispensing carton of unique design and construction and to a blank for such dispensing carton. Such cartons are used for storing and dispensing (Wet-Pack) plastic bags commonly found at checkout counters of grocery stores and supermarkets where they are used to isolate wet items such as frozen food, ice cream, and the like, from other grocery products.

In accordance with an embodiment of the invention there is provided a cut and scored paperboard blank which comprises a bottom panel; a first and second outer end panel connected to opposite sides of the bottom panel; a first and second end panel reinforcing flap connected to a side of the first and second outer end panel remote from the bottom panel; a first side panel connected to a side of bottom panel; an inner reinforcing flap connected to opposite sides of the first side panel; a second side panel connected to a side of bottom panel remote from the first side panel; an inner reinforcing flap connected to opposite sides of the second side panel; an outer top panel connected to a side of the second panel remote from the bottom panel; a reinforcing flap connected to opposite sides of the top panel; and a fastening flap connected to a side of the top panel remote from the second side panel.

In accordance with a further embodiment of the invention there is provided a dispensing carton for plastic bags which comprises a bottom panel; a first and second outer end panel connected to opposite sides of the bottom panel; a first and second end panel reinforcing flap connected to a side of the first and second outer end panel remote from the bottom panel; a first side panel connected to a side of bottom panel; an inner reinforcing flap connected to opposite sides of the first side panel; a second side panel connected to a side of bottom panel remote from the first side panel; an inner reinforcing flap connected to opposite sides of the second side panel; an outer top panel connected to a side of the second panel remote from the bottom panel; a reinforcing flap connected to opposite sides of the top panel; and a fastening flap connected to a side of the top panel remote from the second side panel; the first and second side panels being upstanding at right angles relative to bottom panel; the first side inner reinforcing flaps being upstanding and at right angles to the first side panel; the second side inner reinforcing flaps being upstanding and at right angles to the second side panel; the first and second end panel reinforcing flaps being upstanding and in overlapping downwardly extending relationship with the first and second outer end panels; the outer top panel and sealing flaps overlying the first and second side panels and the inner reinforcing flaps being located inwardly and adjacent the first and second end panel reinforcing flaps.

BRIEF DESCRIPTION OF THE DRAWINGS

The invention will be further understood by reference to the following drawings in which.

DESCRIPTION OF PREFERRED EMBODIMENTS

Figure 1:
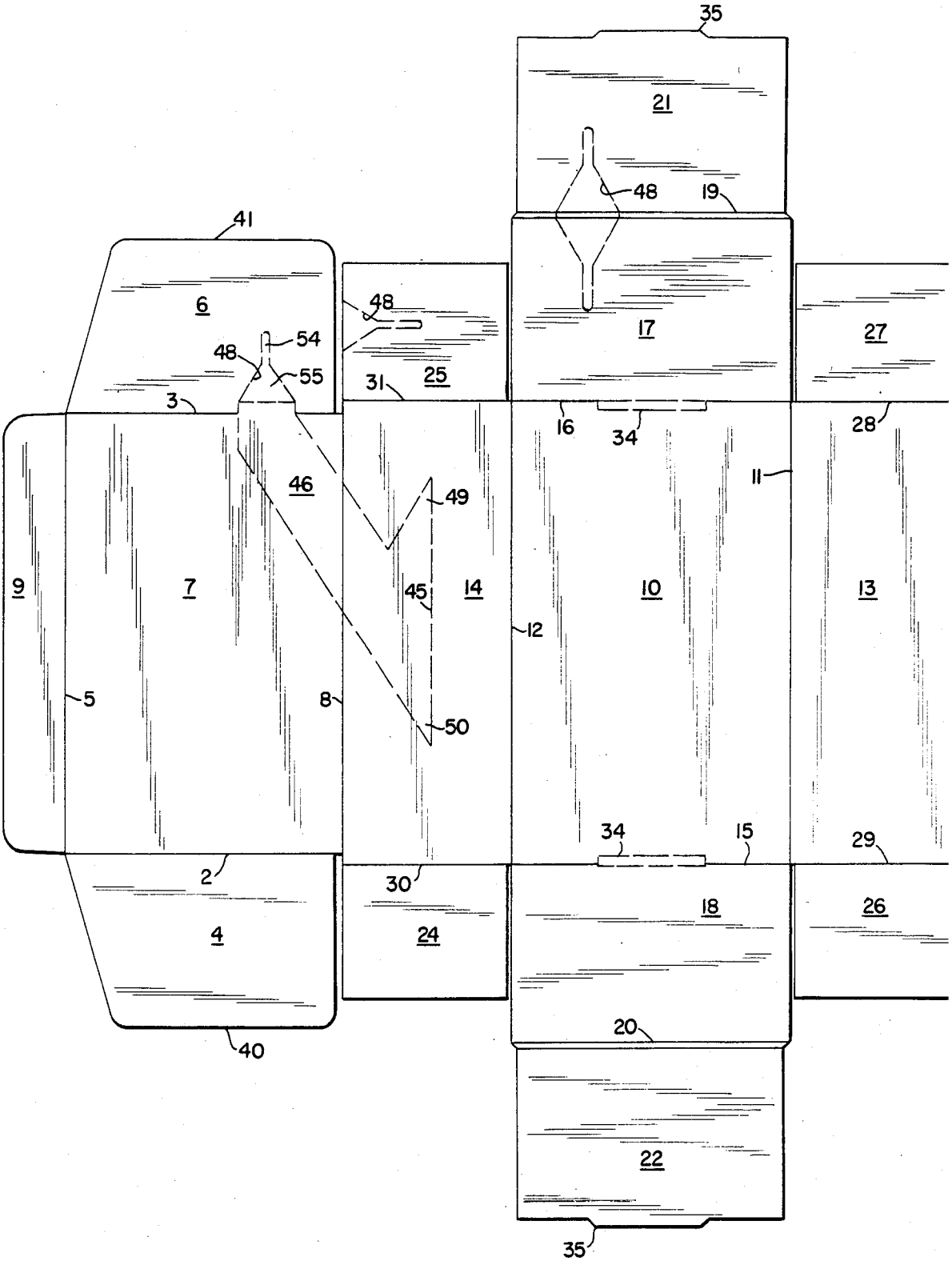
FIG. 1 is a plan view of a paperboard blank for forming a rectangular dispensing carton in accordance with the invention.

A preferred embodiment of the invention is shown in FIG. 1 wherein the dispensing carton may be prepared from a single sheet of suitable paperboard blank stock, such as corrugated cardboard, which is cut and scored and adapted to be folded into a one-piece rectangular container, generally shown in FIGS. 2 to 5.

As illustrated in FIG. 1, the blank includes a generally rectangular bottom panel 10 which is joined on opposite sides by score lines 11 and 12 to foldable rectangular first side panel 13 and second side panel 14. At each of the short ends of panel 10, along score lines 15 and 16, closure slots are provided by die-cuts 34. Adjacent the die-cuts, outer end panels 17 and 18 are joined and foldably connected to panel 10 along score lines 16 and 15, respectively. Foldably connected along score lines 19 and 20 to the sides of end panels 17 and 18 are end panel reinforcing wing flaps 21 and 22. Reinforcing flaps 21 and 22 are approximately the same dimension as their respective end panels 17 and 18 through which they are remotely connected to bottom panel 10. As further noted, reinforcing flaps 21 and 22 are provided with a closure tongue 35 on their outer edge which is adapted to engage and lock in the slots provided in panel 10 when the reinforcing wing flaps 21 and 22 are folded over their respective end panels 17 and 18 in face-to-face relationship and the end panels are rotated inwardly through an angle of 90° about score lines 15 and 16.

Although a closure tongue 35 has been illustrated as a single element for insertion and locking in slot 34, it is within the scope of the invention to utilize two or more small tabs (not shown) which would enter into two or more corresponding smaller die cuts or slots spaced along score lines 15 and 16.

Referring now to first side panel 13, this panel is joined along score lines 28 and 29 with inner reinforcing wing flaps 26 and 27, respectively. Likewise, second side panel 14 is joined along score lines 30 and 31 with inner panel reinforcing wing flaps 24 and 25.

Reinforcing wing flaps 24, 25, 26 and 27 each are approximately the same vertical height as side panels 13 and 14 and slightly greater than about one third the width of the rectangular panels. The width of the wing flaps is not considered critical since in the operation of erecting and closing the carton, the wing flaps may overlap, abut or be spaced apart from one another, as more fully described hereinafter.

The closure means for the dispensing carton of FIG. 1 includes an outer top panel 7 of substantially rectangular configuration which is foldably connected and joined to the second side panel 14 along the crease or score line 8. Reinforcing wing flaps 4 and 6 are foldably connected and joined to top panel 7 along score lines 2 and 3 respectively. Wing flaps 4 and 6 are shown generally as being trapezoidal as defined by edges 40 and 41 to facilitate the folding operation but, alternatively, a rectangular configuration could be employed if desired. The height of the wing flaps are approximately the same height as panel 7 and the width is slightly greater than one-third the width of the panel. The width will be such that it is substantially the same width as the inside of the dispenser which, in turn, substantially corresponds to the width of end panels 17 and 18 and reinforcing flaps 21 and 22. Panel 7 is also provided with a fastening flap 9 along crease or score line 5 which is folded and secured to the outside of panel 13 when the container is assembled.

Figure 3:
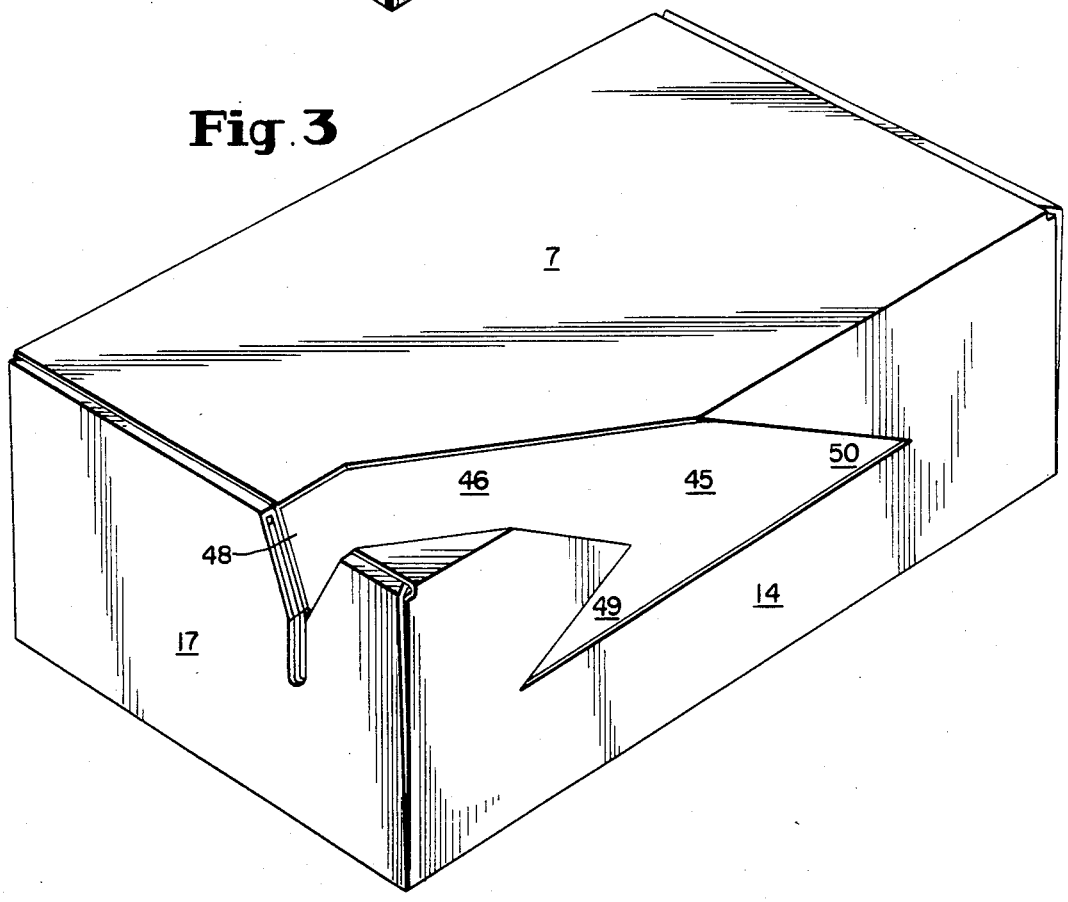
FIG. 3 is a perspective view of the dispensing carton of FIG. 2, with the tear strip removed.
Figure 4:
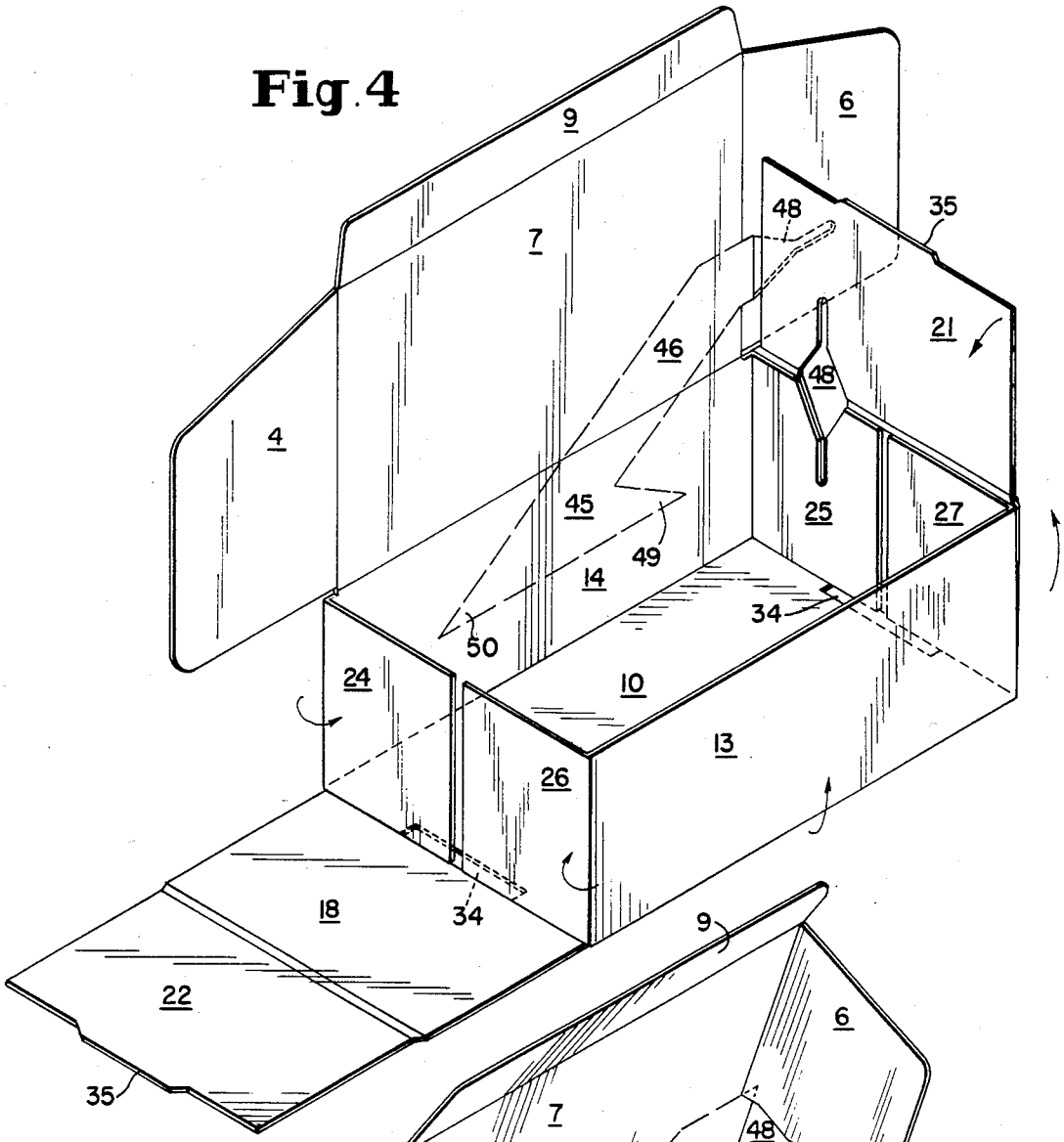
FIG. 4 is a perspective view of a partially folded dispensing carton, as shown in FIG. 2, showing the end, top and side panels and the openings therein.
Figure 5:
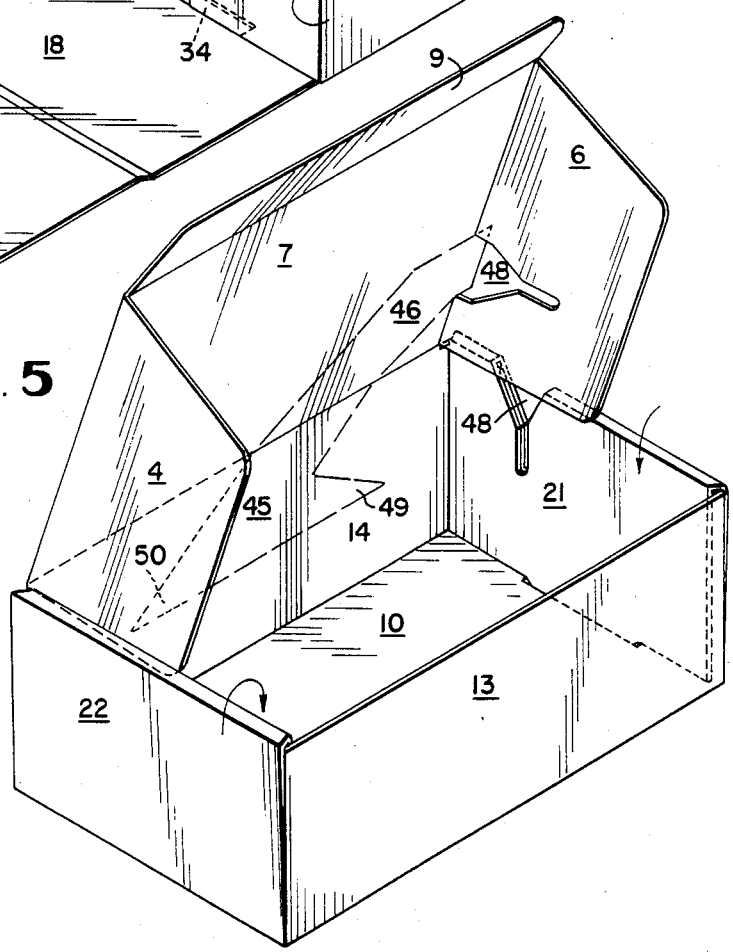
FIG. 5 is a perspective view showing the dispensing carton of FIG. 4 further folded.

FIGS. 4 and 5 illustrate the steps in folding the blank shown in FIG. 1 to erect the dispensing carton. Side panels 13 and 14 are folded inwardly and in an upright position along crease lines 11 and 12. The first side panel inner reinforcing flaps 26 and 27 and the second side panel inner reinforcing flaps 24 and 25 are then rotated inwardly through a ninety degree angle so as to close the ends of the carton. End panels 17 and 18 are folded along crease lines 15 and 16 to an upright position and their respective end panel reinforcing flaps, 21 and 22, are then folded along crease lines 19 and 20 over end panels 17 and 18 and inner reinforcing flaps 24, 25, 26, and 27. Closure tongue 35 is then inserted and locked in slots 34 provided in panel 10. In this manner end panels 17 and 18 are fixedly secured since the inner reinforcing flaps are interlocked between end panels 17 and 18 and their respective end panel reinforcing flaps 21 and 22. To close the carton the top panel reinforcing flaps 4 and 6 are folded along score lines 2 and 3 to an upright position. Top panel 10 may be then folded inwardly along score line 8 to close the carton so that reinforcing flaps 4 and 6 now lie adjacent and in face-to-face relationship to the end panel reinforcing flaps 21 and 22. It will be further noted that when panels 6, 7, 14, 17, 21, and 25 are folded in the position shown in FIGS. 2 and 3, each of the aperture openings 48 will overlie one another. After loading the carton with a roll of center-unwind plastic bags such that the bags are withdrawn from the openings in side panel 14 or end panel 6, the dispensing carton is then suitably secured by taping, gluing, or stapling fastening flap 9 to the outside of panel 13.

An important aspect of the dispensing carton is the means employed for dispensing one bag at a time from a roll of center-unwind plastic bags contained therein. The roll of bags generally comprise a plurality of bags made of plastic material, such as polyethylene or polypropylene, connected to one another in top-to-bottom relationship and scored adjacent their edges for facilitating separation of individual bags from a center unwind coreless roll as disclosed in co-pending application Ser. No. 687,792, filed Dec. 3, 1984. A typical dimension for the plastic bags is 14 inches long, 5½ inches wide and 4–6 inches deep.

Figure 2:
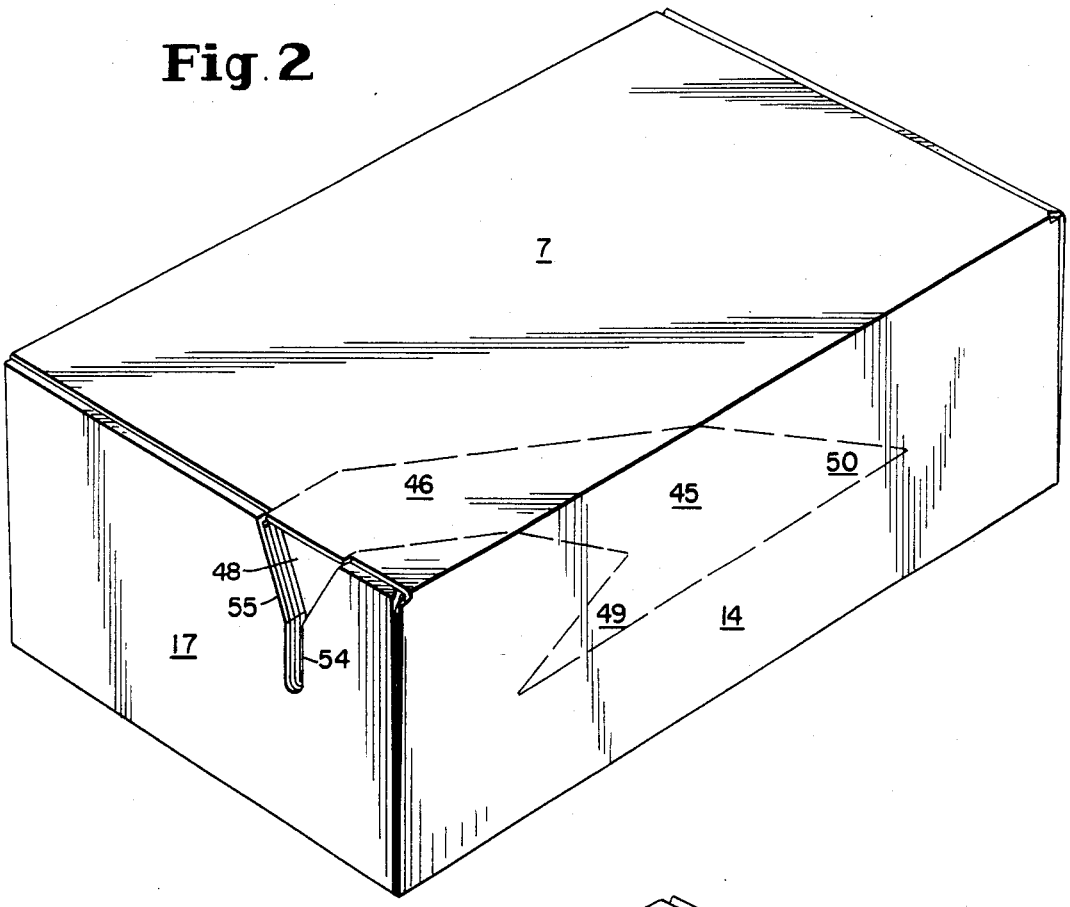
FIG. 2 is a perspective view of an assembled dispensing carton, formed from the blank shown in FIG. 1.

As shown in FIGS. 2 and 3, second side panel 14 has a perforated tear strip opening 45 defining a centrally located triangular-like configuration which communicates and is interconnected with an elongated tear strip passageway 46 which extends diagonally across top panel 7 to tear strip opening 48 in end panel 17. When all the tear strips are removed, the free end of a roll of center-unwind plastic bags may be grasped and withdrawn for separation from the carton through openings 45 or 48, or by being withdrawn from opening 45 through passageway 46 to opening 48 in end panel 17. As bags are desired, for example in wet packaging at a supermarket check-out counter, the free end of a center unwind plastic roll of bags is withdrawn from the apertures in panel 14 or 17 until a complete bag is exposed. The next or following bag is then wedgedly engaged in openings 49, 50 or 54 and the first bag is removed against frictional restraint by snapping or tearing. The perforations between the bags permit the bag to become easily separated. This operation then draws the next bag into dispensing position. By means of this arrangement, the carton provides ready access to single or multiple openings as desired. If either opening 45 or 48 is to be used, the desired perforated tear strip is opened by the operator when he or she is ready to remove one of the bags from the carton. Opening 45 may be partially opened, for example, exposing an opening only on side panel 14, or it may be fully opened to provide a passageway 46 which may or may not communicate with opening 48. In some instances, the operator may find it desirable to leave opening 48 closed and withdraw a bag from opening 45 to passageway 46, separating the bag by manually snapping one from another, rather than separating and removing the bag from wedged engagement only in opening 45. While the configuration of the aperture openings and tearing surfaces are shown as being V or U-shaped, other equivalent configurations are possible providing there is an interconnecting passageway between the apertures in the end and side panels and the apertures have converging edges in which the bag can be tightly wedged and easily torn or snapped off. These features are common to a wide variety of possible configurations which are adaptable to the invention. See, for example, U.S. Pat. No. 4,289,262.

It will be seen from the foregoing disclosure that the blank, cut from a single rectangular sheet in one operation, provides a strong and rigid dispensing carton which serves mutiple functions of (1) being quick and easy to erect, thus minimizing labor costs, (2) making the next plastic bag readily available upon detachment of the preceding bag, (3) making the plastic bag available for detachment from multiple locations, and (4) permitting the use of a permananetly closed (sealed) dispensing carton in which access is provided to the center of the roll of bags in the event of a web tear in the box. In addition, the dispensing carton provides a strong and rigid crush resistant container which can be shipped or stored, as desired.

What is claimed is:

1. A blank for forming a dispensing carton, having bottom, top, side, and end walls, which comprises:

a rectangular bottom panel;

a first and second outer rectangular end panel connected to opposite sides of the bottom panel;

a first and second rectangular end panel reinforcing wing flap connected to a side of the first and second outer end panel remote from the bottom panel;

a first rectangular side panel connected to a side of the bottom panel;

an inner reinforcing wing flap connected to opposite sides of the first rectangular side panel;

a second rectangular side panel connected to a side of the bottom panel remote from the first rectangular side panel;

an inner rectangular reinforcing wing flap connected to opposite sides of the second rectangular side panel;

an outer rectangular top panel connected to a side of the second rectangular side panel remote from the bottom panel;

a reinforcing wing flap connected to opposite sides of the top panel; and a fastening flap connected to a side of the top panel remote from the second side panel, wherein an outer end panel, second side panel and top panel and one of each of their respective reinforcing wing flaps at one end of the blank have perforated tear strips defining aperture openings wherein the perforated tear strip of the second side panel is connected ot the tear strip of the top panel which in turn is connected to the tear strip of its reinforcing wing flap.

2. The blank of claim 1 wherein the bottom panel contains parallel slots along opposite sides thereof and the reinforcing wing flaps connected to the end panels, remote therefrom, have a closure tab for insertion therein.

3. A rectangular dispensing carton for plastic bags, having bottom, top, side, and end walls, and reinforced by at least one additional layer of paperboard material, which comprises:

a rectangular bottom panel;

a first and second outer rectangular end panel connected to opposite sides of the bottom panel;

a first and second rectangular end panel reinforcing wing flap connected to a side of the first and second outer end panel remote from the bottom panel;

a first rectangular side panel connected to a side of the bottom panel;

an inner reinforcing wing flap connected to opposite sides of the first rectangular side panel;

a second rectangular side panel connected to a side of the bottom panel remote from the first rectangular side panel;

an inner rectangular reinforcing wing flap connected to opposite sides of the second rectangular side panel;

an outer rectangular top panel connected to a side of the second rectangular side panel remote from the bottom panel;

a reinforcing wing flap connected to opposite sides of the top panel; and a fastening flap connected to a side of the top panel remote from the second side panel;

the first and second rectangular side panels being upstanding at right angles relative to the bottom panel;

the first rectangular side inner reinforcing wing flaps being upstanding and at right angles to the first rectangular side panel;

the second side inner reinforcing wing flaps being upstanding and at right angles to the second side panel;

the first and second outer end panels being upstanding and at right angles to the first and second side panels;

the first and second end panel reinforcing wing flaps being upstanding and in overlapping downwardly extending relationship with the first and second outer end panels;

the fastening flap of the outer top panel being in face to face relationship with the first rectangular side panel and the inner reinforcing wing flaps being located inwardly and adjacent the first and second end panel reinforcing wing flaps, wherein the outer end panel, second side panel, and top panel and one of each of their respective reinforcing wing flaps at one end of the carton have perforated tear strips defining aperture openings wherein the perforated tear strip of the second side panel is connected to the tear strip of the top panel which in turn is connected to the tear strip of its reinforcing wing flap, whereby the defined aperture openings in the outer end panel and said reinforcing wing flaps overlie one another.

4. The carton of claim 3 wherein the bottom panel contains parallel slots along opposite sides thereof and the reinforcing wing flaps connected to the end panels, remote therefrom, have a closure tab for insertion therein.

5. The carton of claim 4 wherein at least one of the perforated tear strips is removed.

6. In combination, the carton of claim 5 and a roll of center-unwind plastic bags disposed therein, said bags being connected to one another in top to bottom relationship and scored adjacent their connecting edges.

* * * * *